US007970329B2

(12) United States Patent
Suzuki

(10) Patent No.: US 7,970,329 B2
(45) Date of Patent: Jun. 28, 2011

(54) IMAGE HEATING APPARATUS INCLUDING A BELT MEMBER FOR HEATING AN IMAGE ON A RECORDING MATERIAL

(75) Inventor: Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 760 days.

(21) Appl. No.: 11/531,407

(22) Filed: Sep. 13, 2006

(65) Prior Publication Data

US 2007/0071523 A1 Mar. 29, 2007

(30) Foreign Application Priority Data

Sep. 14, 2005 (JP) ..... 2005/267546

(51) Int. Cl.
*G03G 15/20* (2006.01)

(52) U.S. Cl. ..... 399/329; 219/216

(58) Field of Classification Search ..... 399/329; 219/216

See application file for complete search history.

(56) References Cited

U.S. PATENT DOCUMENTS

| | | | | |
|---|---|---|---|---|
| 6,483,088 | B2 | 11/2002 | Uehara et al. | 219/619 |
| 6,795,679 | B2 | 9/2004 | Shimizu et al. | 399/333 |
| 7,205,514 | B2 | 4/2007 | Suzuki et al. | 219/619 |
| 2005/0173415 | A1 | 8/2005 | Yamamoto et al. | 219/619 |
| 2005/0281595 | A1* | 12/2005 | Kachi | 399/329 |
| 2006/0086720 | A1 | 4/2006 | Nakase et al. | 219/619 |
| 2006/0086724 | A1 | 4/2006 | Yamamoto et al. | 219/619 |
| 2006/0086726 | A1 | 4/2006 | Yamamoto et al. | 219/619 |
| 2006/0086730 | A1 | 4/2006 | Kondo et al. | 219/645 |
| 2006/0088327 | A1 | 4/2006 | Nakase et al. | 399/69 |
| 2006/0245797 | A1 | 11/2006 | Suzuki | 399/328 |
| 2007/0014601 | A1* | 1/2007 | Yasuda et al. | 399/329 |
| 2008/0175633 | A1* | 7/2008 | Shinshi | 399/329 |
| 2008/0226324 | A1* | 9/2008 | Baba et al. | 399/328 |

FOREIGN PATENT DOCUMENTS

| | | |
|---|---|---|
| EP | 2000-268952 | 9/2000 |
| JP | 10-74004 | 3/1998 |
| JP | 2002-110336 | 4/2002 |
| JP | 2003-223063 | 8/2003 |
| JP | 2004-170622 | 6/2004 |
| JP | 2004-205538 | 7/2004 |
| JP | 2005-203273 | 7/2005 |
| JP | 2005283983 A * | 10/2005 |

OTHER PUBLICATIONS

Japanese Office Action dated Nov. 30, 2010, in Japanese Application No. 2005-267546, and English-language translation thereof.

* cited by examiner

*Primary Examiner* — David M Gray
*Assistant Examiner* — Ruth N Labombard
(74) *Attorney, Agent, or Firm* — Fitzpatrick, Cella, Harper & Scinto

(57) ABSTRACT

An image heating apparatus includes an endless belt for heating an image on a recording material at a nip; magnetic flux generating means, disposed opposed to an outer surface of the endless belt, for generating a magnetic flux to cause the belt to generate heat; a metal member disposed inside the belt and supporting a member which is disposed inside the belt; and a magnetic flux reducing member, disposed between the metal member and an opposing portion of the belt which is opposed to the magnetic flux generating means, for reducing a magnetic flux actable on the metal member.

6 Claims, 7 Drawing Sheets

IMAGE HEATING APPARATUS INCLUDING A BELT MEMBER FOR HEATING AN IMAGE ON A RECORDING MATERIAL

FIELD OF THE INVENTION AND RELATED ART

The present invention relates to an image heating apparatus for heating an image on a recording material. An image heating apparatus is usable as a fixing apparatus in which an unfixed image formed on a recording material is fixed, and a glossiness applying apparatus in which an image fixed on a recording material is heated to improve the glossiness of the image, and so on.

An image forming apparatus such as a copying machine or a printer comprises an image forming station, and an image heat-fixing apparatus for heating and fixing the toner image formed by the image forming station on the recording material into a permanent fixed image.

Recently, in the field of an image heat-fixing apparatus, an electromagnetic-induction-heating-type fixing apparatus has been put into practice in place of a fixing apparatus of a heating-roller type having a halogen lamp as a heating source, since the electromagnetic-induction-heating-type fixing apparatus is advantageous in saving energy and in starting quickly.

Japanese Laid-open Patent Application Hei 10-074004 discloses such an apparatus in which, as shown in FIG. 11, an endless fixing belt 4 having an electromagnetic-induction-heat-generation property and an endless pressing belt 3 are press-contacted to each other to form a nip (fixing nip) N. Inside the pressing belt, there is provided a coil unit 10. In order to raise the heating efficiency of the fixing belt 4, which generates heat by the magnetic flux provided by the induction coil 6 of the coil unit 10, a magnetic member 9 is disposition inside the fixing belt. The fixing belt 4 is caused to generate heat by the magnetic flux generated by the induction coil 6, and the recording material P carrying the toner image is nipped and fed by the nip N so that a toner image on the recording material P is heated and fixed on the recording material. Designated by reference numerals 1, 2 are driving rollers for the pressing belt 3 and for the fixing belt 4, respectively. Designated by reference numerals 14, 15 are tension rollers for the pressing belt 3 and the fixing belt 4, respectively. Designated by reference numeral 8 is an excitation core around which an induction coil 6 of the coil unit 10 is wound; designated by reference numeral 7 is a temperature sensor for detecting the temperature of the fixing belt 4.

With such a structure, the fixing belt can be made small and thin, by which the thermal capacity is reduced, so that warming-up period can be shortened.

However, with the structure of Japanese Laid-open Patent Application Hei 10-074004, the belt has such a small thickness that magnetic flux generated by the coil disposed outside penetrates the belt and acts on the temperature sensor disposed inside the belt and/or the metal member disposed inside the fixing belt. If this occurs, the problem with this structure is not limited to the heat generation of the unintended metal member, but also includes a decrease in the belt-heating efficiency corresponding to the amount of heat generated in the metal member, and/or, a decrease in the amount of heat generation around the metal member with the result of a non-uniformity in the temperature.

SUMMARY OF THE INVENTION

Accordingly, it is a principal object of the present invention to provide an image heating apparatus in which a magnetic flux generated by the coil disposed outside a belt is used to generated heat and in which the adverse influence of the magnetic flux having penetrated into the inside of the belt, which influence is imparted on the member disposed inside the belt, is reduced so that decrease of the heating efficiency attributable to the inside metal member is reduced.

It is another object of the present invention to provide an image heating apparatus in which the decrease of the heating efficiency attributable to the influence of the magnetic flux leaking into the inside of the belt on the metal member provided inside the belt.

According to an aspect of the present invention, there is provided an image heating apparatus comprising an endless belt for heating an image on a recording material at a nip; magnetic flux generating means, disposed opposed to an outer surface of said endless belt, for generating a magnetic flux to cause said belt to generate heat; a metal member disposed inside said belt and supporting a member which is disposed inside said belt; and a magnetic flux reducing member, disposed between said metal member and an opposing portion of said belt which is opposed to said magnetic flux generating means, for reducing a magnetic flux actable on said metal member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the present invention will be described in detail with reference to the appended drawings.

Embodiment 1

(1) Example of Image Forming Apparatus

Figure 3:
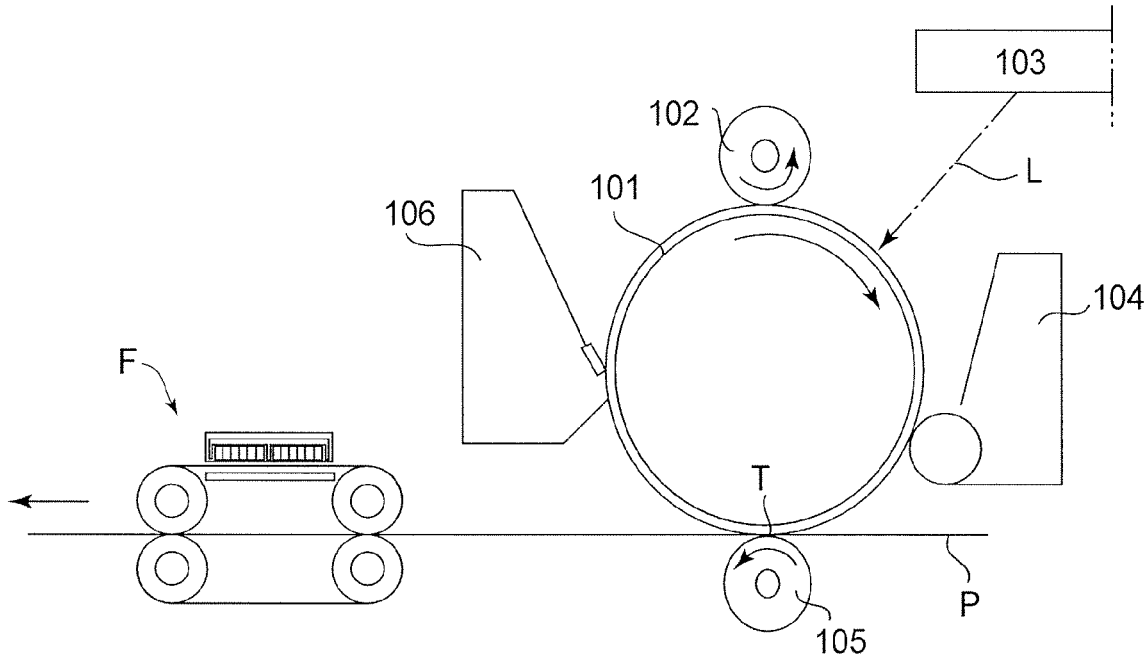
FIG. 3 is a schematic view of an image forming apparatus.

FIG. 3 is a schematic drawing of an image forming apparatus in which an image heating apparatus in accordance with the present invention is mountable as a fixing apparatus, showing the general structure thereof. This image forming apparatus is a laser beam printer which uses an electrophotographic image formation process.

Designated by reference numeral 101 is a photosensitive drum as an image bearing member. The photosensitive drum 101 is made up of a cylindrical substrate formed of aluminum, nickel, or the like, and a layer of photosensitive substance, such as OPC, amorphous Selenium, or amorphous Silicon, coated on the peripheral surface of the cylindrical substrate. The photosensitive drum 101 is rotationally driven in the clockwise direction indicated by an arrow mark. As the photosensitive drum 101 is rotated, first, its peripheral surface is uniformly charged by a charge roller 102 as a charging apparatus. Next, the uniformly charged area of the peripheral surface of the photosensitive drum 101 is exposed by a laser scanner unit 103 as an exposing apparatus; the uniformly charged area is scanned with a beam of laser light projected from the laser scanner 103 while being turned on or off in response to the picture data. As a result, an electrostatic latent image is formed on the peripheral surface of the photosensitive drum 101. This electrostatic latent image is developed into a visible image by a developing apparatus 104, and toner as developer. As the developing method, the jumping developing method, the two component developing method, the FEED developing method (Floating Electrode Effect Development), etc., are used. In many cases, these methods are used in combination with an exposure process and a reversal development process.

Meanwhile, a sheet of recording medium P, such as a sheet of transfer medium, is conveyed from an unshown feeding-and-conveying mechanism to a transfer nip T, which is the interface between the photosensitive drum 101, and a transfer roller 105 as a transferring apparatus. While the recording medium P is conveyed through the transfer nip T, the toner image on the peripheral surface of the photosensitive drum 101 is electrostatically transferred onto the recording medium P by the transfer roller 105. This recording medium P is separated from the peripheral surface of the photosensitive drum 101 while bearing the unfixed toner image, and is conveyed to an image heating fixing apparatus F (which hereafter will be referred to simply as fixing apparatus). Then, the toner image is thermally fixed to the surface of the recording medium P by the fixing apparatus F, turning into a permanent image.

The transfer residual toner, that is, the toner remaining on the photosensitive drum 101 after the transfer, is removed by a cleaning apparatus 106 from the peripheral surface of the photosensitive drum 101, enabling the photosensitive drum 101 to be repeatedly used for image formation.

(2) Fixing Apparatus F

Figure 1:
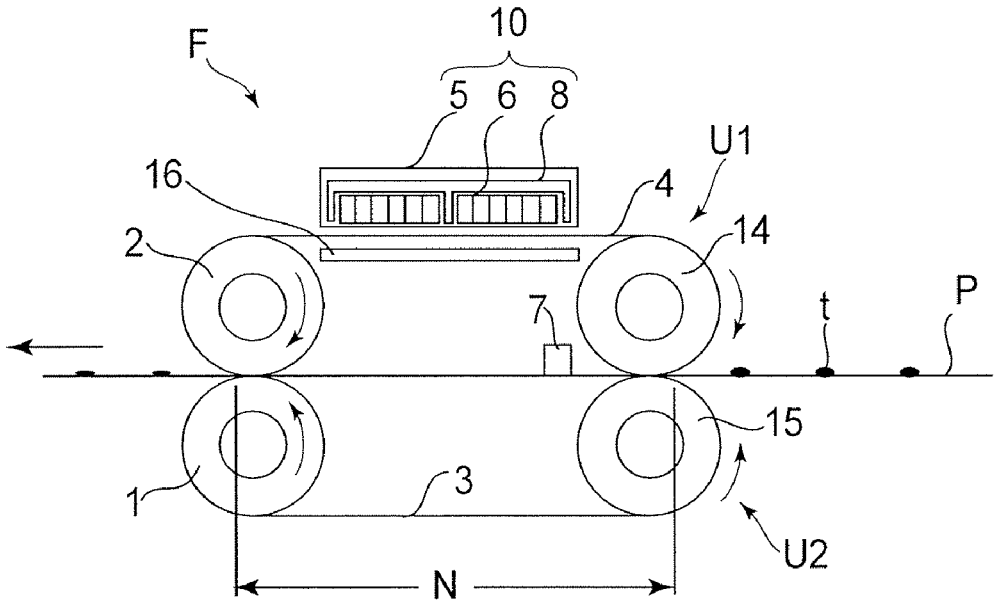
FIG. 1 is a cross-section of a fixing apparatus according to an embodiment of the present invention.

FIG. 1 is a schematic vertical cross-sectional view of the fixing apparatus F in this embodiment. The fixing apparatus F uses a heating method based on electromagnetic induction (IH fixing device), and a belt-based fixing method.

In the following description of the fixing apparatus, the lengthwise direction of the fixing apparatus or the components thereof is the direction parallel to the width direction of the recording medium P, which is perpendicular to the recording-medium conveyance direction X. The width direction of the fixing apparatus or the components thereof is the direction parallel to the recording-medium conveyance direction X. Further, the upstream side is the side from which recording medium P is introduced into the fixing apparatus F in terms of the recording-medium conveyance direction. The downstream side is the side from which the recording medium P is discharged from the fixing apparatus F in terms of the recording-medium conveyance direction.

Moreover, in order to clearly show the structural differences between the structural members of the fixing apparatus F and those of a conventional fixing apparatus, that is, a fixing apparatus in accordance with the conventional art, structural members of the former that are the same in function as the structural members of the latter are given the same reference symbols.

Designated by a reference symbol U1 is a fixation unit as a fixing means, and designated by a reference symbol U2 is a pressure application unit functioning as a pressure applying means. The fixation unit U1 and the pressure application unit U2 are vertically stacked so that the unit U1 is on top of the unit U2. They are kept pressured against each other, forming a nip (fixation nip) N between the two units U1 and U2. Designated by a reference symbol 10 is a coil unit functioning as a magnetic flux generating means, and is disposed above the fixing unit U1. Designated by a reference symbol 16 is a heat concentration member, which is a nonmagnetic member, and is disposed on the inward side of the loop which the fixation belt of the fixation unit U1 forms.

1) Fixation Unit U1

The member of the fixation unit U1, which is denoted by a reference numeral 2, is a fixation roller, which is disposed on the downstream side. Designated by a reference numeral 14 is a top tension roller, which is disposed on the upstream side. The fixation roller 2 and the top tension roller 14 are both long and narrow members, the rotational axes of which are parallel to the lengthwise direction. They are rotatably supported at their lengthwise ends by the unshown pair of the lateral plates of the fixing apparatus F. Designated by a reference numeral 4 is a flexible endless fixation belt. It is stretched around the abovementioned two rollers 2 and 14 so that it is provided with a certain amount of tension. That is, the fixation belt 4 is suspended by the fixation roller 2 and the top tension roller 14, being stretched between the two rollers 2 and 14.

Figure 2:
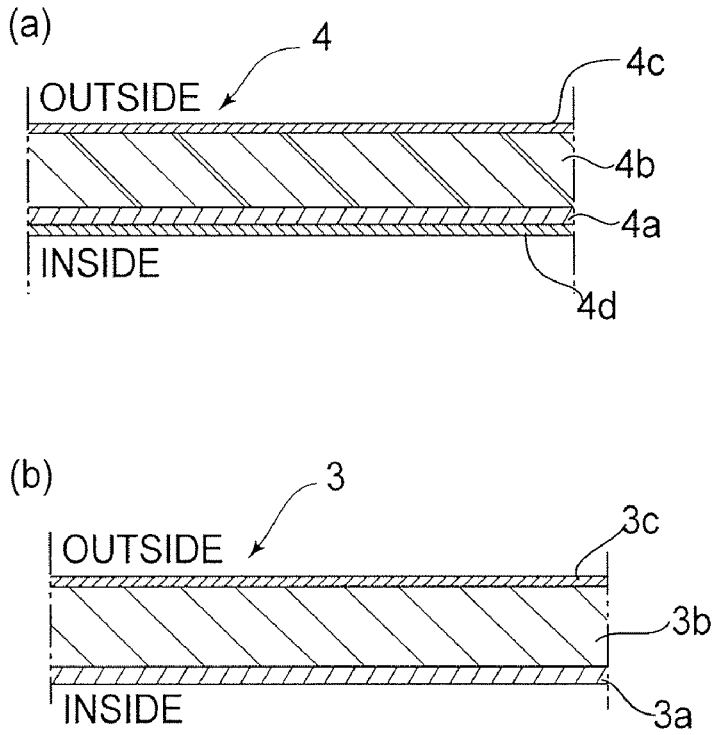
FIG. 2 is a schematic sectional view (a) of an example of a layer structure of a fixing belt according to the present invention, and a schematic sectional view of an example of a layer structure of a pressing belt.

FIG. 2(*a*) is a schematic sectional view of the fixation belt 4 in this embodiment, showing the laminar structure thereof. The fixation belt 4 is circularly driven. Therefore, it is desired to be relatively thin. The fixation belt 4 has an endless heat generation layer 4*a* (which hereafter will be referred to as metallic layer), which constitutes the substrate layer. The fixation belt 4 is made up of the metallic layer 4*a*, an elastic layer 4*b* layered on the outward surface (outward circumferential surface) of the metallic layer 4*a*, and a release layer 4*c*, as the surface layer, layered on the outward surface of the elastic layer 4*b*, and a polyimide layer 4*d* layered on the inward surface (inward circumferential surface) of the metallic layer 4*a*. The heat generation layer 4*a*, in which heat is generated by electromagnetic induction, is formed of Ni, Fe, SUS, Cu, Al, Ag, Au, or the like. Increasing the thickness of the heat generation layer 4*a* increases the rigidity of the belt itself, making it difficult to rotationally drive the belt. Therefore, the thickness of the heat generation layer 4*a* is desired to be no more than 0.2 mm, for example. On the outward surface of the metallic layer 4*a*, the elastic layer 4*b*, which is formed of nonmagnetic substance, such as silicon rubber or polyimide, is layered to a thickness in a range of 100 μm-500 μm. However, the thickness of the elastic layer 4*b* does not need to be limited to the value in this range. As the material for the release layer 4*c*, that is, the surface layer, layered on the outward surface of the elastic layer 4*b*, fluorinated resin (for example, PFA) is used.

2) Pressure Application Unit 2

The member of the pressure application unit U2, which is designated by a reference numeral 1 is a pressure roller, which is disposed on the downstream side. Designated by reference numeral 15 is a bottom tension roller, which is disposed on the upstream side. The pressure roller 1 and the bottom tension roller 15 are both long and narrow members, the rotational axes of which are parallel to the lengthwise direction. They are rotatably supported at their lengthwise ends by the pair of the lateral plates of the fixing apparatus F. Designated by reference numeral 3 is a flexible endless pressure application belt (which hereafter will be referred to simply as a pressure belt). It is stretched around the abovementioned two rollers 1 and 15 so that it is provided with a certain amount of tension. That is, the pressure belt 3 is suspended by the pressure roller 1 and the bottom tension roller 15, being stretched between the two rollers 1 and 15. The pressure roller 1 and the bottom tension roller 15 are kept pressed against the fixation roller 2 and the top tension roller 14, that is, the opposing rollers, by unshown pressure application springs (pressure applying means), with the pressure belt 3 and the fixation belt 4 interposed between them, respectively. Thus, the pressure belt 3 is kept pressed upon the fixation belt 4, forming a nip N between the fixation belt 4 and the pressure belt 3.

FIG. 2(*b*) is a schematic sectional view of the pressure belt 4 in this embodiment, showing the laminar structure thereof. The pressure belt 3 has an endless substrate layer 3*a* formed of polyimide. The reason for using polyimide as the material for the substrate layer 3*a* is that because the pressure belt 3 is not heated by electromagnetic induction, it does not require a metallic layer. The pressure belt 3 is made up of the substrate layer 3*a*, an elastic layer 3*b* layered on the outward surface (outward circumferential surface) of the substrate layer 3*a* to a preset thickness, and a release layer 3*c*, as the surface layer, layered on the outward surface of the elastic layer 3*b*. As the materials for the elastic layer 3*b* and release layer 3*c*, the same materials as those for the fixation belt 4 are used.

3) Coil Unit 10

The coil unit 10 is disposed on the outward side of the loop formed by the fixation belt 4. The coil unit 10 has an induction coil 6 (which hereafter will be referred to as a coil), an excitation core 8 (which hereafter will be referred to as a core), and a coil holder 5 (which hereafter will be referred to as a holder). Each of the core 8 and the holder 5 is a long and narrow member, which extends in the lengthwise direction. The hollow of the core 8, which is E shaped in vertical cross section, supports therein the coil 6 formed by flatly winding Litz wire so that its cross section, at a plane parallel to the fixation belt 4, is in the form of an elongated circle, the long axis of which is parallel to the lengthwise direction. The holder 5, by which the core 8 is supported, is supported at its lengthwise ends, by the pair of lateral plates of the fixing apparatus F, so that the coil 6 opposes the outward surface of the fixation belt 4.

4) Thermal Fixing Operation

In the fixing apparatus F in this embodiment, the fixation roller 2 and the pressure roller 1 of the fixation unit U1 and the pressure application unit U2, respectively, are rotationally driven in preset directions by unshown driving systems. As the fixation roller 2 is rotationally driven by the unshown driving system in the clockwise direction, the fixation belt 4 runs in the same direction, whereas as the pressure roller 1 is rotationally driven in the counterclockwise direction, and the pressure belt 3 runs in the same direction.

While the fixation roller 2 and pressure roller 1 are rotationally driven, high frequency electric current (which is roughly 10 kHz-100 kHz in frequency) is applied to the induction coil 6 of the coil unit 10, in response to the command from the control portion (controlling means). As the high frequency current is applied, a magnetic field which is perpendicular to the belt movement direction, is generated in the metallic layer 4*a* of the fixation belt 4 by the high frequency current. As a result, electric current is induced in the metallic layer 4*a* of the fixation belt 4 by this magnetic field (magnetic flux). This electric current induced in the metallic layer 4*a* is converted into heat (Joule heat) by the specific electric resistance of the metallic layer 4*a*. Thus, the fixation 2 is heated by this Joule heat.

The temperature level of the fixation belt 4 is detected by a temperature sensor 7 (temperature detecting means). The temperature sensor 7 is disposed on the inward side of the fixation belt loop. Where the temperature sensor 7 is positioned does not need to be limited to the inward side of the fixation belt loop; it has only to be in the adjacencies of the fixation belt 4. The temperature sensor 7 is disposed in contact, or virtually in contact with, the fixation belt 4. The information regarding the temperature of the fixation belt 4 detected by the temperature sensor 7 is taken in by the control portion, which controls the electric power source for driving the high frequency waves, so that the temperature of the fixation belt 4 is maintained at a preset fixation temperature (target temperature).

As the fixation belt 4 and pressure belt 3 run together, with the temperature of the fixation belt 4 kept at the fixation level, the recording medium P on which an unfixed toner image t is borne is introduced into the abovementioned nip N, through which the recording medium P is conveyed while remaining pinched between the two belts 4 and 3. While the recording medium P is conveyed through the nip N, the toner image t is fixed to the surface of the recording medium P by the heat from the fixation belt 4 and the pressure from the pressure belt 3, being thereby turned into a permanent image.

5) Measures for Improving Fixation Belt 4 in Heating Efficiency, and Reducing Effects of Magnetic Flux upon Components near Fixation Belt As described above, for the purpose of smoothly rotating the fixation belt 4, the heat generation layer 4*a* of the fixation belt 4 is desired to be no more than 0.2 mm. However, if the thickness of the heat generation layer 4*a* is no more than 0.2 mm, the magnetic field generated by flowing electric current through the coil 6 to heat the heat generation layer by electromagnetic induction penetrates the fixation belt 4, because the thin heat generation layer 4*a* fails to completely absorb the magnetic flux. This phenomenon occurs when the thickness of the heat generation layer 4*a* is close to the skin depth; it is more conspicuous where the thickness of the heat generation layer 4*a* is less than the skin depth. The skin effect can be generally expressed by the following mathematical formula, more particularly the skin depth δ is $$\delta = \sqrt{\frac{2\rho}{\omega\mu}} \quad \text{(m)}$$

ρ: electrical resistivity, ω: angular frequency, and μ: permeability.

For reference, the skin thicknesses of ordinary substances are given in the following table:

TABLE 1

| | Resistivity | Relative permeability Ω · m | Skin depth mm |
|---|---|---|---|
| Fe | 9.8E−08 | 100 | 0.11 |
| SUS 430 (Stainless Use Steel) | 6E−07 | 100 | 0.28 |
| SUS 304 (Stainless Use Steel) | 7.2E−07 | 1 | 3.02 |
| Al | 2.5E−08 | 1 | 0.56 |
| Cu | 1.7E−08 | 1 | 0.46 |
| Ni | 7E−08 | 50 | 0.19 |

As the magnetic flux penetrates the fixation belt 4, the components on the inward side of the fixation belt loop are affected by the magnetic flux; the magnetic flux is lost by unintendedly generating heat in the components. This means that the amount by which heat is generated in the fixation belt 4 is reduced, provided that the usable amount of electric power is constant. Therefore, this phenomenon is not a good thing, from the viewpoint of thermal efficiency.

Thus, a metallic member (which hereafter will be referred to as heat concentration member 16, which is a magnetic flux reduction member, is disposed on the inward side of the magnetic fixation belt loop, so that it opposes the coil unit 10. The heat concentration member 16 is a long and narrow member, which extends in the lengthwise direction. It is in the form of a flat plate, the width (in terms of the direction parallel to the belt rotation direction) of which is the same as the width (in terms of the direction parallel to the belt rotation direction) of the coil unit 10. Further, the length (dimension in terms of the direction perpendicular to recording medium conveyance direction) of the magnetic flux reduction member 16 roughly matches the entire length of the excitation coil as a magnetic flux generating means. The magnetic flux reduction member 16 is supported at its lengthwise end portions by the pair of lateral plates of the fixing apparatus F, so that it opposes the coil unit 10. As the material for the heat concentration member 16, a substance which is thick in skin and small in electric resistivity or permeability is used. For example, a substance, such as Ag, Cu, or Al, which is high in electrical conductivity and low in internal loss, is preferable.

With the heat concentration member 16 disposed on the inward side of the fixation belt loop, the magnetic flux having penetrated the fixation belt 4 can be absorbed by the heat concentration member 16. Therefore, it is possible to reduce the effect of the magnetic flux upon the electrically conductive members in the fixation belt loop, which is on the pressure belt side of the heat concentration member 16. Therefore, the amount by which heat is generated in the heat generation layer 4*a* becomes relatively greater. The magnitude of this effect is proportional to the thickness of the heat concentration member 16. Thus, the thickness of the heat concentration member 16 is desired to be no less than the thickness of the skin of the concentration member 16, which is calculated in terms of the value of the property of the substance used as the material for the heat concentration member 16. For example, when copper is used as the material for the heat concentration member 16, the thickness of the heat concentration member 16 is desired to be no less than 0.46 mm.

Embodiment 2

Figure 4:
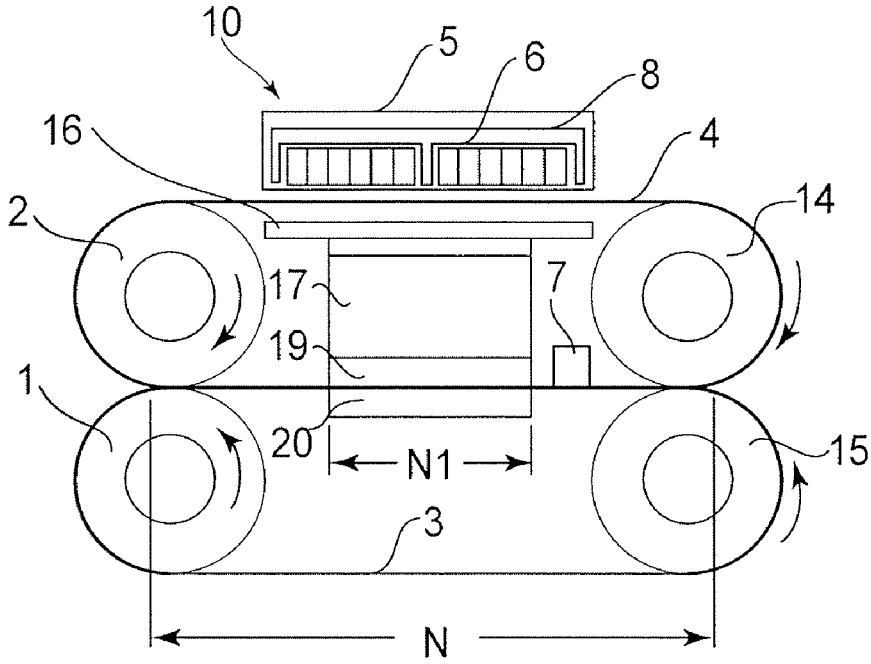
FIG. 4 is a cross-section of a fixing apparatus according to a second embodiment of the present invention.

FIG. 4 is a schematic vertical cross-sectional view of the fixing apparatus in this embodiment.

The members and portions of this fixing apparatus, which are the same as those of the fixing apparatus in the first embodiment, are given the same referential symbols as those given to describe the first embodiment, and will not be described here. This arrangement regarding the referential symbols also applied to the third to fifth embodiments.

The fixing apparatus F in this embodiment has a stay 17, which is disposed on the inward side of the fixation belt loop, and to which the components to be disposed on the inward side of the fixation belt loop are attached. The stay 17 is supported at this lengthwise ends by the pair of lateral plates of the fixing apparatus F. To the bottom surface of this stay 17, that is, the surface of the stay 17, which is on the nip side, a fixation pad 19 is attached. The fixation belt 4 and pressure belt 3 are pinched by this fixation pad 19, and a pressure pad 20 supported by the pair of the lateral plates of the fixing apparatus F, forming a belt nip N1, within the nip N. Thus, while the recording medium P is conveyed through this belt nip N1, remaining pinched between the two belts 4 and 3, the outward surface of the fixation belt 4 is kept in contact with the surface of the recording medium P, with no gap between the two surfaces. Therefore, the toner image t is excellently fixed by the heat from the fixation belt 4.

In order to form the belt nip N1 within the nip N, the stay 17 to which the fixation pad 19 is attached must be strong enough to keep the belt nip N1 uniform in terms of the lengthwise direction of the nip N. Thus, forming the stay 17 of iron or SUS (Stainless Use Steel), which has overall strength, is preferable from the standpoint of versatility, and also, is better from the standpoint of cost. However, forming the stay 17 of iron or SUS makes the stay 17 magnetic, and also, high in electrical resistivity, which in turn makes greater the effect of the magnetic flux upon the stay 17.

For example, assuming that the heat generation layer 4*a* of the fixation belt 4 is formed of Ni and 50 μm in thickness; the stay 17 is formed of SUS 304; and the distance between the stay 17 and coil 6 is 6 mm, if 1,000 W of high frequency electric current, which is 30 kHz in frequency, is inputted into the coil 6 under the abovementioned conditions, the thermal loss attributable to the stay 17 is roughly 370 W.

In comparison, placing a piece of 0.5 mm thick copper plate, as the heat concentration member 16, on the top surface of the stay 17 in the fixation belt loop can reduce the thermal loss; the thermal loss attributable to the combination of the stay 17 and heat concentration member 16 is roughly ⅓ of the thermal loss attributable to the heat concentration member 16 alone.

In other words, not only can the placement of the heat concentration member 16 between the inward surface of the fixation belt 4 and the top surface of the stay 17 reduce the thermal loss attributable to the stay 17, but also, make it possible to use a high strength substance as the material for the stay 17.

Figure 5:
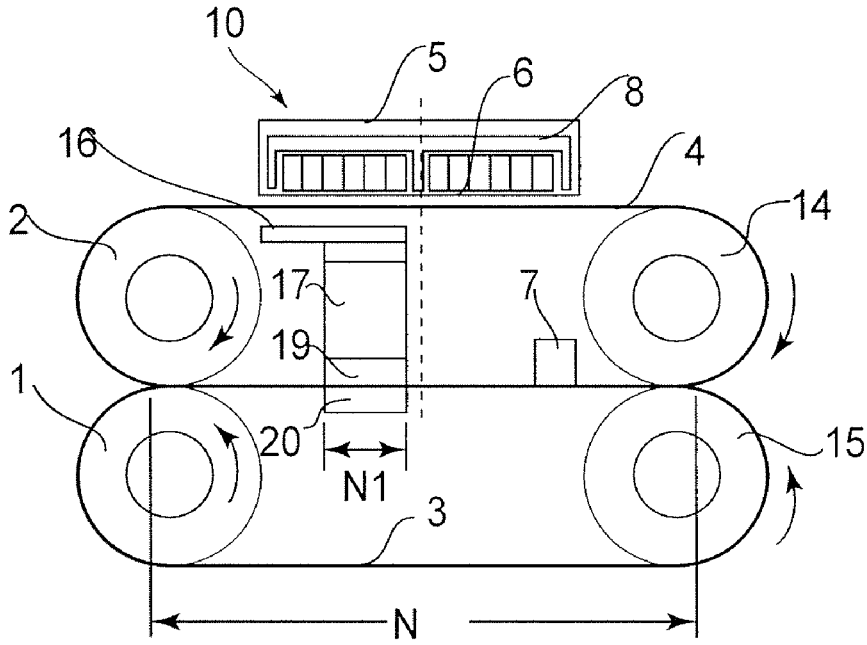
FIG. 5 is a cross-section of a fixing apparatus according to a modified example of the second embodiment of the present invention.

FIG. 5 is a schematic vertical cross-sectional view of another fixing apparatus in this embodiment.

Referring to FIG. 5, in this fixing apparatus F, the stay 17 and heat concentration member 16 are disposed on either the upstream or downstream side with reference to the centerline (which indicated by dotted line) of the coil 6 in terms of the width direction of the fixing apparatus. This positioning of the heat concentration member 16 and stay 17 further reduces the thermal loss attributable to the heat concentration member 16 and stay 17; it can reduce the thermal loss attributable to the combination of the stay 17 and heat concentration member 16, to roughly ⅓ the amount of thermal loss which is caused by the combination of the stay 17 and heat concentration member 16 set up as shown in FIG. 4, under the aforementioned conditions.

Embodiment 3

Figure 6:
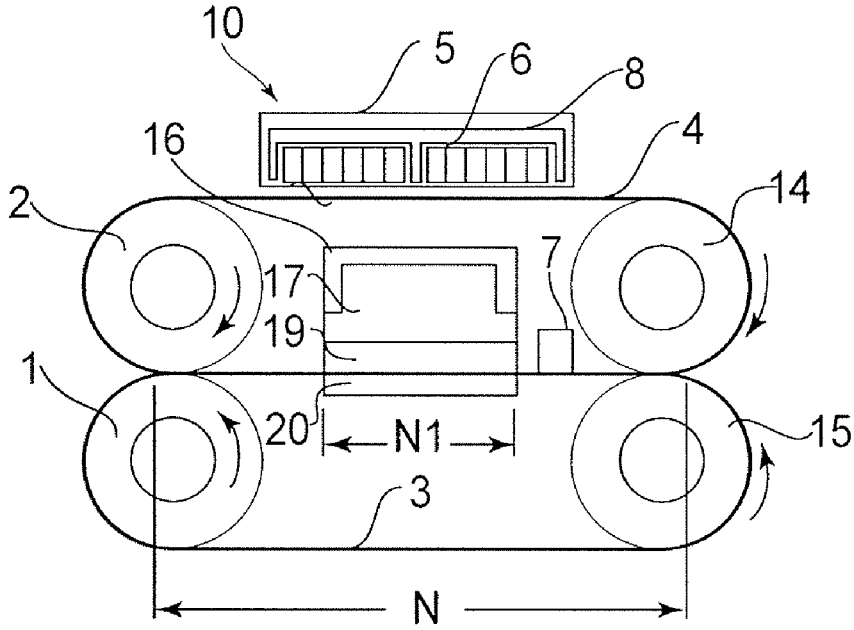
FIG. 6 is a cross-section of a fixing apparatus according to a third embodiment of the present invention.
Figure 7:
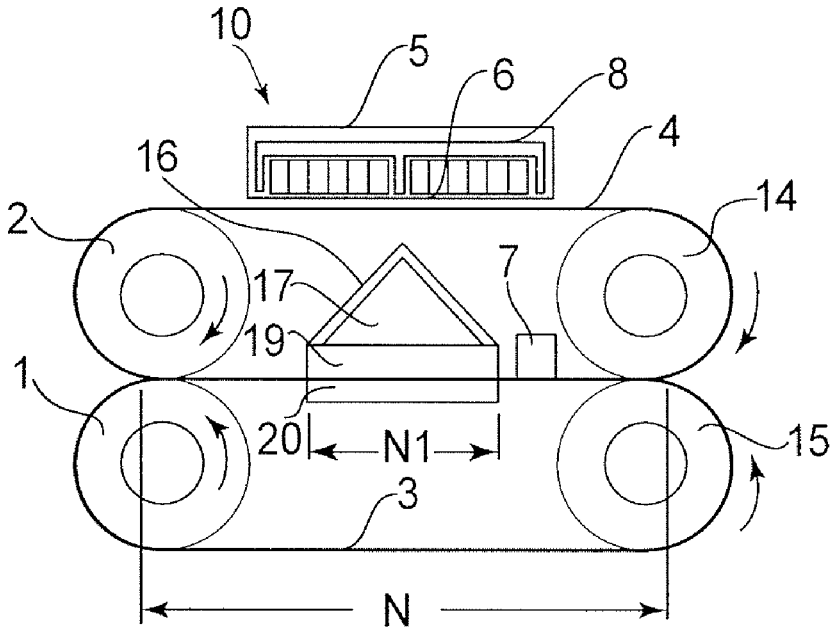
FIG. 7 is a cross-section of a fixing apparatus according to a modified example of the third embodiment of the present invention.

FIG. 6 is a schematic vertical cross-sectional view of one of the fixing apparatus in this embodiment. FIG. 7 is a schematic vertical cross-sectional view of the other of the fixing apparatus in this embodiment.

The fixing apparatus F in this embodiment has the modified version of the heat concentration member 16 in the second embodiment; the heat concentration member 16 in the second embodiment has been devised in shape to be rendered more rigid.

The length of the heat concentration member 16 is the same as the dimension of the fixation belt 4 in the lengthwise direction. Therefore, it is possible that the heat concentration member 16 will warp or bend across its center portion in terms of the lengthwise direction. It is also possible that the heat concentration member 16 will be difficult to handle when assembling the fixing apparatus F.

In this embodiment, therefore, the heat concentration member 16 is formed as an integral part of the stay 17, preventing thereby the heat concentration member 16 from warping or bending across its center portion in terms of the lengthwise direction, and also, making it easier to handle. When forming the heat concentration member 16 as an integral part of the stay 17, the heat concentration member 16 is desired to be formed in a specific shape, in particular, in a manner to enclose the stay 17 so that the stay 17 is not affected by the generated magnetic flux. As for the examples of the shape of the heat concentration member 16, the loss can be reduced by giving the heat concentration member 16 a U-shaped cross section, such as the one shown in FIG. 6. The loss can also be reduced by giving the heat concentration member 16 an L-shaped cross section, such as the one shown in FIG. 7.

As for the means for forming the heat concentration member 16 as an integral part of the stay 17, the heat concentration member 16 may be bonded to the stay 17 with the use of a bonding agent, or screwed to the stay 17. Further, the heat concentration member 16 may be directly formed on the stay 17 by plating. Further, the heat concentration member 16 and stay 17 may be integrally molded using heat resistant resin. In such a case, they are effective to block the heat from the fixation belt 4, being therefore effective to improve the fixing apparatus F in fixation performance.

Embodiment 4

Figure 8:
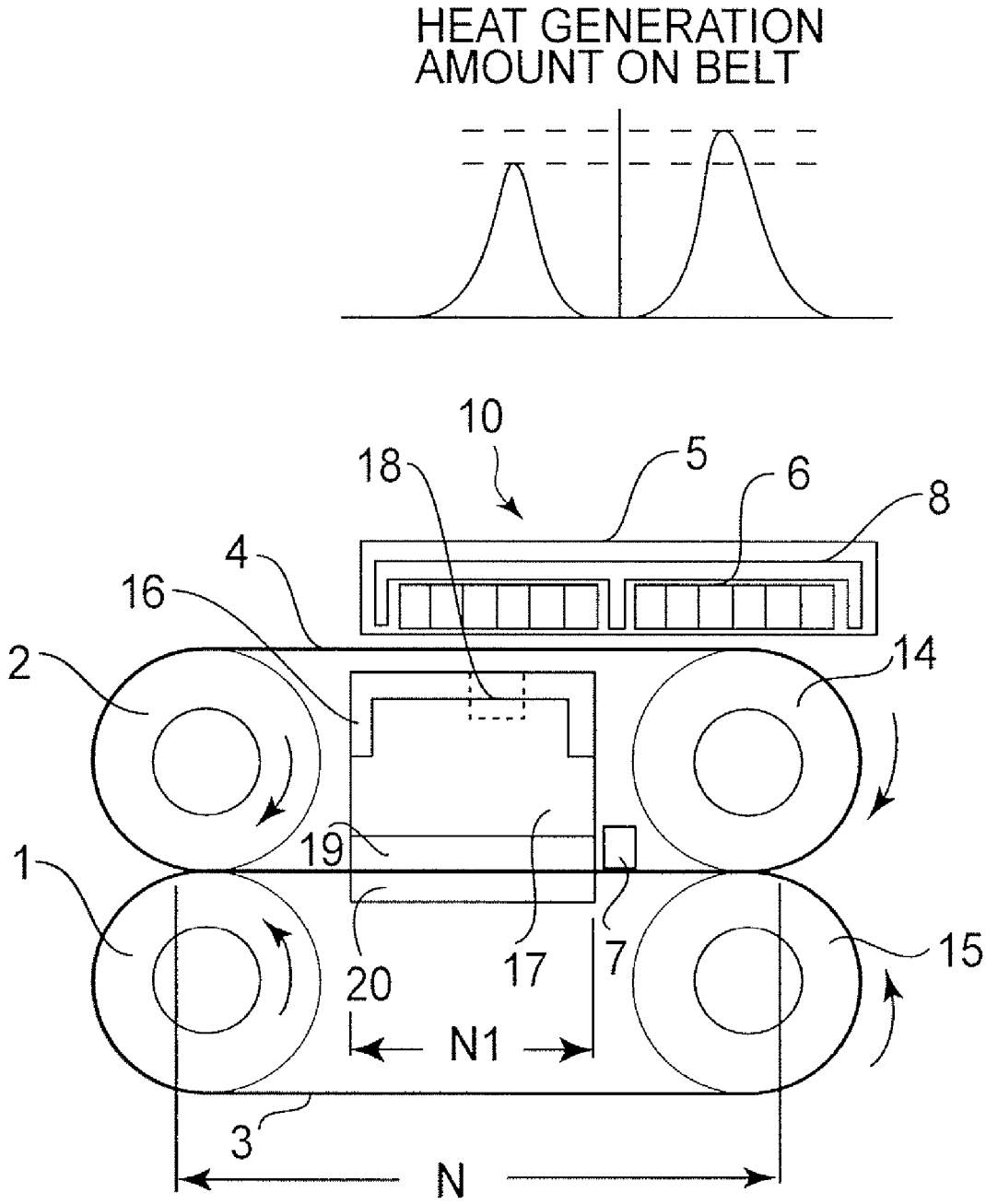
FIG. 8 is a cross-section of a fixing apparatus according to a fourth embodiment of the present invention.
Figure 9:
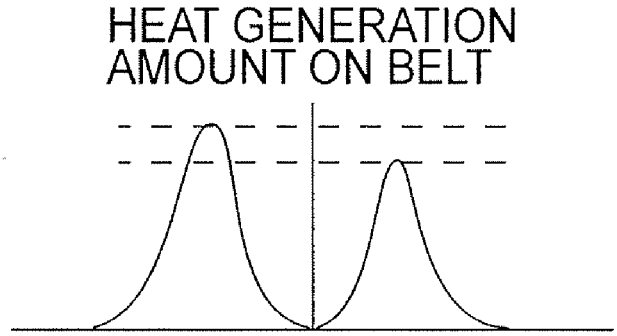
FIG. 9 is a cross-section of a fixing apparatus according to a modified example of the fourth embodiment of the present invention.
Figure 9:
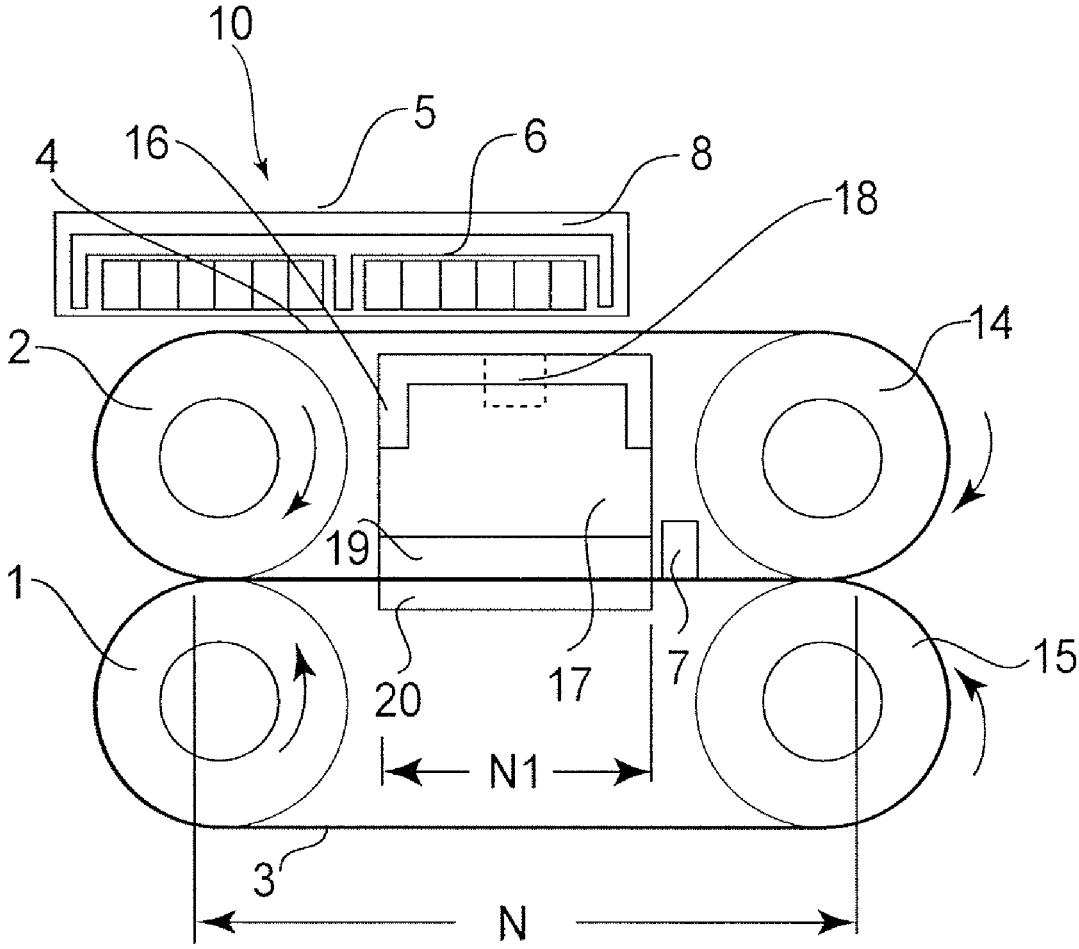

FIG. 8 is a schematic cross-sectional view of one of the fixing apparatus F in this embodiment, and FIG. 9 is a schematic sectional view of the other of the fixing apparatus F in this embodiment.

Referring to FIG. 8, in the fixing apparatus in this embodiment, the coil unit 10 formed by winding Litz wire around the core 8 is disposed so that the upstream half (right-hand half) of the coil 6 is positioned next to the top tension roller 14, with the fixation belt 4 positioned between the upstream half of the coil 6 and top tension roller 14, and also, so that the downstream half (left-hand half) of the coil 6 is positioned next to the heat concentration member 16, with the fixation belt 4 positioned between the downstream half of the coil 6 and heat concentration member 16. Further, the fixing apparatus is provided with a thermostat SW 18, which is disposed so that it opposes the fixation belt 4. In terms of the vertical direction, the thermostat SW 18 is positioned so that the heat concentration member 16 is between the thermostat SW 18 and fixation belt 4. In terms of the lengthwise direction, the thermostat SW 18 is positioned at the center of the fixing apparatus.

Some thermostats have a cover formed of aluminum for better thermal conductivity, and a bimetal or the like formed of magnetic metals, being therefore susceptible to magnetic flux. Thus, by placing the thermostat SW 18 on the bottom surface of the heat concentration member 16, in the nip N, it is possible to prevent the thermostat SW 18 from being electromagnetically heated, and therefor, making it possible to accurately detect the temperature of the fixation belt 4 itself. In this case, the heat concentration member 16 may be provided with a slit or the like so that the heat receiving surface of the thermostat SW 18 directly faces the fixation belt 4. Further, positioning the signal wire on the rear side (as seen from coil side) of the heat concentration member 16 when placing the thermostat SW 18, a temperature detection thermistor (unshown), or the like, on the inward side of the belt loop, is effective to reduce the effects of the induction noise caused by the magnetic field.

Further, the provision of the heat concentration member 16 improves the fixing apparatus in terms of safety. That is, should the fixation belt 4 break, the collateral damages will be minimum. More specifically, if the fixation belt 4 is severed in a fixing apparatus having a heat concentration member 16 formed of a substance higher in electrical conductivity than the fixation belt 4 and top tension roller 14, impedance substantially changes; severing of the fixation belt reduces in size the magnetically connected portions, causing the impedance to reduce. Thus, the high frequency electric current from the high frequency electric power source inversely changes, that is, increases. Thus, damage to r the fixation belt 4 can be detected by detecting the amount of electric current. As the method for detecting the electric current, an ordinary current detecting method, such as a current transformer or a current detection resistor, is sufficient. As for the current to be detected, the input current from the public utility power lines may be detected, or the current which flows through the coil 6 may be directly detected.

The fixing apparatus F which employs the fixation belt 4 is advantageous in that it is shorter in startup time (it increases faster in temperature) because the fixation belt 4 is smaller in thermal capacity. Further, the employment of the fixation belt 4 makes it possible to form a wider fixation nip (nip N), making it possible to improve the fixing apparatus in fixation performance. However, the fixing apparatus employing the fixation belt 4 suffers from its own problems. That is, the fixation belt 4 rises very quickly in temperature. Therefore, if an unknown anomaly occurs to the apparatus, the temperature detection by the thermostat SW 18 or the like may be not fast enough to prevent further damages to the apparatus. For example, if an anomaly occurs to the motor for driving the pressure roller 1 or fixation roller 2, it is possible that the pressure belt 3 or fixation belt 4 will be heated without being rotated. In this situation, if the temperature detection is slow, it is possible for the temperature of the fixation belt 4 to exceed the temperature range of the elastic layer 4*b* and the like of the fixation belt 4, leading to the damages to the fixation belt 4.

In this embodiment, therefore, the fixing apparatus is structured to increase the amount of heat is generated in the portion of the heat generating member that opposes one half (downstream half) of the coil 6, with reference to the long axis of the coil 6. The heat concentration member 16 is disposed in the adjacencies of the same half of the coil 6, with the fixation belt 4 positioned between the heat concentration member 16 and the coil 6. Further, the heat concentration member 16 is not placed in contact with the fixation belt 4. With the employment of the above described structural arrangement, the amount of heat generated in the portion of the fixation belt 4 that opposes the downstream half of the coil 6 is rendered greater than the amount of heat generated in the portion of the fixation belt 4 that opposes the upstream half of the coil 6.

That is, the amount of heat generated in the portion of the fixation belt 4 that opposes the upstream half of the coil 6 is smaller than the amount of heat generated in the portion of the fixation belt 4 that opposes the downstream half of the coil 6, and the heat concentration member 16.

Further, the coil unit 10 is disposed so that the upstream half of the coil 6 is positioned in the adjacencies of the top tension roller 14, with the fixation belt 4 positioned between coil 6 and top tension roller 14. Therefore, the portion of the fixation belt 4 that is next to the top tension roller 14, is greater in thermal capacity, so that the temperature of this portion is slower to increase. On the other hand, the downstream half of the coil 6 is positioned in the adjacencies of the heat concentration member 16, with the fixation belt 4 positioned between the coil 6 and heat concentration member 16. Therefore, the temperature of the portion of the fixation belt 4 that opposes the downstream half of the coil 6 increases.

In this case, the total amount of the reduction in the heat generated in the fixation belt 4 by the presence of the heat concentration member 16 is roughly the same as the total amount of the reduction in the heat generated in the fixation belt 4 in the absence of the heat concentration member 16. That is, the reduction in the amount of heat is generated in the fixation belt 4 caused by the heat concentration member 16 is the amount of heat primarily consumed on the top tension roller side. In other words, a certain percentage of the heat generated in the portion of the fixation belt 4 that opposes the upstream half of the coil 6 is consumed by the portion of the fixation belt 4 that corresponds to the upstream half of the coil 6, so that this portion of the fixation belt 4 has a greater in thermal capacity. Therefore, the temperature of the portion of the fixation belt 4 that corresponds to the remaining half of the coil 6 increases more slowly.

As the materials for the top tension roller 14, there are Fe, Ni, Co, ferrite, silicon steel, magnetic shunt steel. The greater the permeability and electrical resistivity of the material, relative to those of the metallic layer 4*a* of the fixation belt 4 or heat concentration member 16, the more effective the material. As the materials for the heat concentration member 16, there are Ag, Cu, Al, etc. The greater the permeability and electrical resistivity of the material, relative to those of the metallic layer 4*a* of the fixation belt 4 or the top tension roller 14, the more effective, the material.

With the employment of the above described structural arrangement, the fixation belt 4, which is small in thermal capacity, can be kept relatively small in the speed at which its temperature increases, making it possible to ensure that the temperature of the fixation belt 4 can be accurately detected so that the current is cut off for safety, by the thermal switch SW 18.

Referring to FIG. 9, the coil unit 10 of the fixing apparatus F in this embodiment may be disposed so that the downstream half of the coil 6 is positioned in the adjacencies of the fixation roller 2, with the fixation belt 4 positioned between the downstream half of the coil 6 and fixation roller 2, whereas the upstream half of the coil 6 is positioned in the adjacencies of the heat concentration member 16, with the fixation belt 4 positioned between the upstream half of the coil 6 and heat concentration member 16. Such a structural arrangement yields the same effects as those described above.

Embodiment 5

Figure 10:
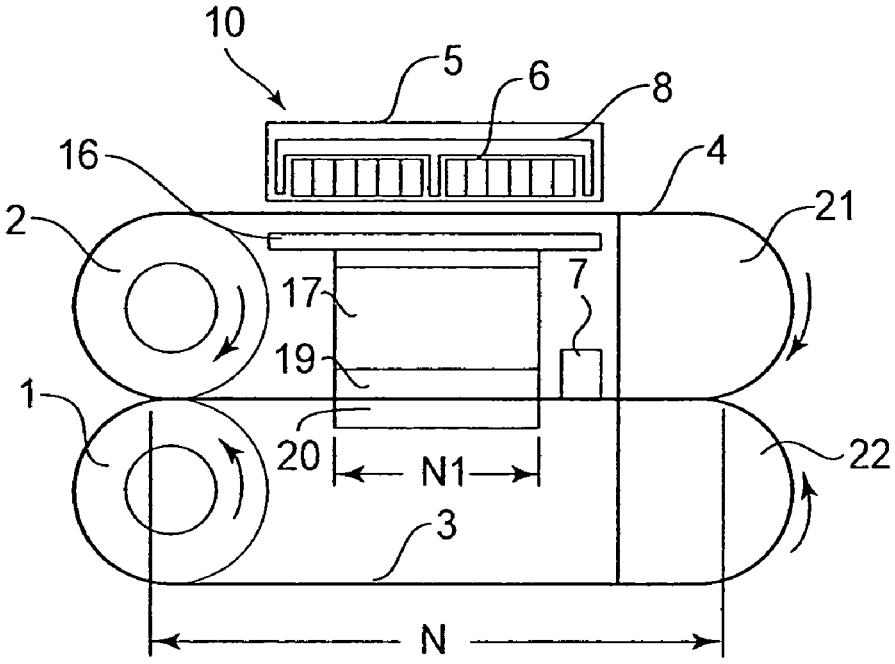
FIG. 10 is a cross-section of a fixing apparatus according to a fifth embodiment of the present invention.
Figure 11:
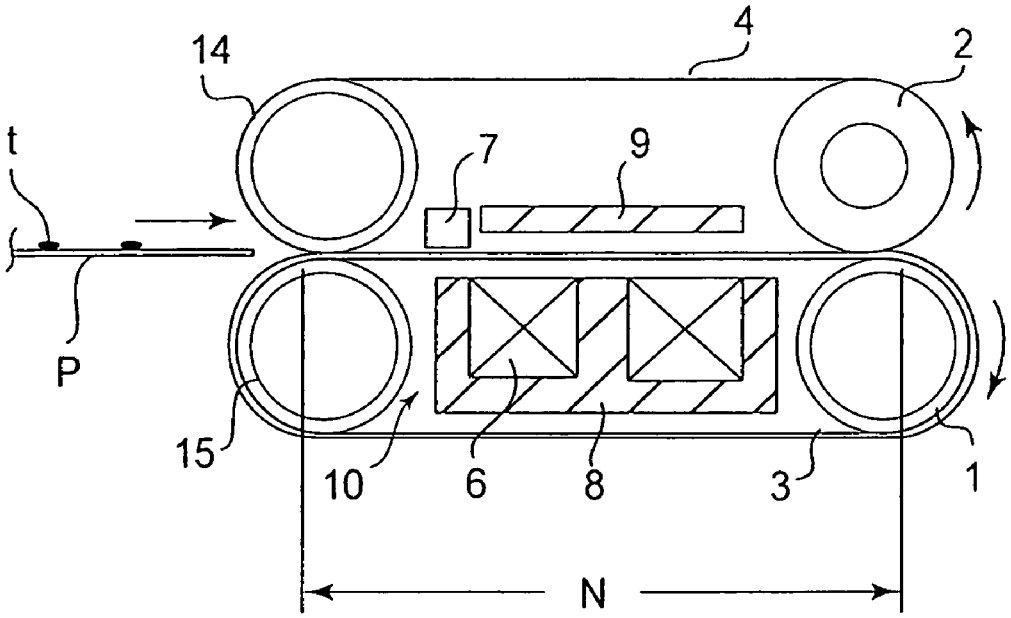
FIG.11 PRIOR ART
FIG. 11 is a cross-section of a conventional fixing apparatus.

FIG. 10 is a schematic cross-sectional view of the fixing apparatus in this embodiment.

The first to fourth embodiments were described with reference to the fixing apparatuses in which the fixation belt 4 was driven by the pressure roller 1 and fixation roller 2. However, guiding members 21 and 22 may be provided in place of the top and bottom tension rollers for rotating the pressure belt 3 and fixation belt 4.

MISCELLANIES

1) In each of the fixing apparatuses in the embodiments of the present invention described above, the coil unit 10 may be disposed on the inward side of the fixation belt loop while the heat concentration member 16, which opposes the coil unit 10, with the fixation belt 4 positioned between the heat concentration member 16 and coil unit 10, may be disposed on the outward side of the fixation belt loop. Positioning the coil unit 10 and heat concentration member 16 in this manner yields the same effects as those described above.

2) Not only can a fixing apparatus in accordance with the present invention be used as the fixing apparatuses in the preceding embodiments, but also, it can be effectively used as an image heating apparatus, such as a fixing apparatus for temporarily fixing an unfixed image to recording medium, or a surface property altering apparatus for reheating the recording medium, which is bearing a fixed image, to alter the surface properties, such as glossiness, of the image.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 267546/2005 filed Sep. 14, 2005 which is hereby incorporated by reference.

What is claimed is:

1. An image heating apparatus comprising:

a rotatable belt member, including an electroconductive layer, configured to heat an image on a recording material;

a coil, which is disposed opposed to an outer surface of said belt member and which is formed by winding along a widthwise direction of said belt member about a winding center, configured to generate, a magnetic flux to cause said belt member to generate heat;

a pressing member urging an outer surface of said belt member;

a stretching member configured to stretch said belt member;

nip forming means, having a metal member, configured to form a nip for nipping and feeding a recording material by urging said pressing member through said belt member; and an electroconductive member, composed of material having an electroconductivity higher than that of said stretching member, configured to reduce the magnetic flux acting on said metal member, said electroconductive member being disposed between said endless belt and said metal member, wherein said electroconductive member is opposed to a part of said coil upstream of the winding center with respect to a rotational direction of said endless belt with the endless belt interposed therebetween, and said stretching member is opposed to a downstream part of said coil with the endless belt interposed therebetween.

2. An apparatus according to claim 1, wherein said non-magnetic electroconductive member opposes a substantially entire area of said belt member with respect to a widthwise direction of said belt member.

3. An apparatus according to claim 1, further comprising a temperature detecting member for detecting a temperature of said belt member, and control means for controlling electric power supply to said coil on the basis of an output of said temperature detecting member so that the temperature of said belt member is a predetermined temperature, wherein a skin depth of the magnetic flux acting on said electroconductive layer in the state that control means controls the electric power supply to said coil is larger than a depth of said electroconductive layer.

4. An apparatus according to claim 1, wherein said electroconductive member reduces a magnetic flux extending from said coil acting on said metal member.

5. An apparatus according to claim 1, wherein a part of said metal member adjacent to a surface of said belt opposed to said coil is covered by said electroconductive member.

6. An apparatus according to claim 1, further comprising a temperature detector in said belt member for detecting the temperature, wherein said electroconductive member is provided between said temperature detector and said coil.

* * * * *